US008821111B2

(12) United States Patent
Gear et al.

(10) Patent No.: US 8,821,111 B2
(45) Date of Patent: Sep. 2, 2014

(54) GAS TURBINE VANE WITH COOLING CHANNEL END TURN STRUCTURE

(75) Inventors: Paul J. Gear, Longwood, FL (US); Brian J. Wessell, Orlando, FL (US); Daniel M. Eshak, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 900 days.

(21) Appl. No.: 12/967,156

(22) Filed: Dec. 14, 2010

(65) Prior Publication Data

US 2012/0148383 A1 Jun. 14, 2012

(51) Int. Cl.
*F01D 9/04* (2006.01)
*F01D 5/18* (2006.01)

(52) U.S. Cl.
CPC ..... *F01D 5/187* (2013.01); *F05D 2250/185* (2013.01); *F01D 9/041* (2013.01); *F05D 2240/10* (2013.01)
USPC ..... 415/115; 416/97 R

(58) Field of Classification Search
USPC ..... 415/115, 116; 416/90 R, 96 R, 97 R
See application file for complete search history.

(56) References Cited

U.S. PATENT DOCUMENTS

| | | | | |
|---|---|---|---|---|
| 4,218,178 | A | 8/1980 | Irwin | |
| 5,498,126 | A * | 3/1996 | Pighetti et al. | 415/115 |
| 5,511,309 | A * | 4/1996 | Beabout | 29/889.72 |
| 5,669,759 | A | 9/1997 | Beabout | |
| 6,709,230 | B2 | 3/2004 | Morrison et al. | |
| 6,955,523 | B2 * | 10/2005 | McClelland | 415/115 |
| 7,090,461 | B2 | 8/2006 | Liang | |
| 7,150,601 | B2 * | 12/2006 | Pietraszkiewicz et al. | 416/97 R |
| 7,293,957 | B2 | 11/2007 | Ellis et al. | |
| 7,445,432 | B2 * | 11/2008 | Levine et al. | 416/96 R |
| 7,775,769 | B1 * | 8/2010 | Liang | 416/97 R |
| 7,785,072 | B1 * | 8/2010 | Liang | 416/97 R |
| 7,967,567 | B2 * | 6/2011 | Liang | 416/97 R |
| 8,142,153 | B1 * | 3/2012 | Liang | 416/1 |
| 8,221,055 | B1 * | 7/2012 | Liang | 415/115 |
| 8,511,968 | B2 * | 8/2013 | Liang et al. | 415/115 |
| 2007/0297916 | A1 * | 12/2007 | Levine et al. | 416/96 R |
| 2010/0054915 | A1 * | 3/2010 | Devore et al. | 415/116 |
| 2012/0063908 | A1 * | 3/2012 | Islam et al. | 416/223 A |
| 2012/0148383 | A1 * | 6/2012 | Gear et al. | 415/115 |

OTHER PUBLICATIONS

George Liang et al.; U.S. Appl. No. 12/540,418, filed Aug. 13, 2009; entitled "Turbine Vane for a Gas Turbine Engine Having Serpentine Cooling Channels".

* cited by examiner

*Primary Examiner* — Edward Look
*Assistant Examiner* — Christopher R Legendre

(57) ABSTRACT

A vane structure for a gas turbine engine. The vane structure includes a radially outer platform and a radially inner platform, and an airfoil having an outer wall extending radially between the outer platform and the inner platform. A cooling passage is defined within the outer wall and has a plurality of radially extending channels. An outer end turn structure is located at the outer platform to conduct cooling fluid in a chordal direction between at least two of the channels. The outer end turn structure includes an enlarged portion wherein the enlarged portion is defined by an enlarged dimension, in a direction transverse to the chordal direction, between the at least two channels.

16 Claims, 5 Drawing Sheets

GAS TURBINE VANE WITH COOLING CHANNEL END TURN STRUCTURE

FIELD OF THE INVENTION

The present invention is directed generally to turbine vanes, and more particularly to turbine vanes having cooling channels for conducting a cooling fluid through the vane.

BACKGROUND OF THE INVENTION

In a turbomachine, such as a gas turbine engine, air is pressurized in a compressor section then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for powering the compressor section and providing output power. Since the airfoils, i.e., vanes and turbine blades, are directly exposed to the hot combustion gases, they are typically provided with an internal cooling passage that conducts a cooling fluid, such as compressor bleed air, through the airfoil.

One type of airfoil extends from a radially inner platform at a root end to a radially outer portion of the airfoil, and includes opposite pressure and suction sidewalls extending axially from leading to trailing edges of the airfoil. The cooling channel extends inside the airfoil between the pressure and suction sidewalls and conducts the cooling fluid in alternating radial directions through the airfoil.

SUMMARY OF THE INVENTION

In accordance with an aspect of the invention, a vane structure is provided for a gas turbine engine. The vane structure comprises a radially outer platform and a radially inner platform. An airfoil is provided including an airfoil outer wall extending radially between the outer platform and the inner platform, and the outer wall includes chordally spaced leading and trailing edges. A cooling passage is defined within the outer wall and has a plurality of radially extending channels. An outer end turn structure is located at the outer platform to conduct cooling fluid in a chordal direction between at least two of the channels. The outer end turn structure includes an enlarged portion wherein the enlarged portion is defined by an enlarged dimension, in a direction transverse to the chordal direction, between the at least two channels.

In accordance with another aspect of the invention, a vane structure is provided for a gas turbine engine. The vane structure comprises a radially outer platform including an inner surface defining a portion of a hot gas path through the gas turbine engine and an opposing outer surface in communication with a cooling fluid source. A radially inner platform is provided including an outer surface defining a portion of the hot gas path and an opposing inner surface. An airfoil is provided including an airfoil outer wall extending radially between the outer platform and the inner platform, and the outer wall includes chordally spaced leading and trailing edges. A cooling passage is defined within the outer wall and has a plurality of radially extending channels including an upstream channel, a downstream channel and a medial channel between the upstream channel and the downstream channel. An outer end turn structure extends radially outwardly from the outer surface of the outer platform to conduct cooling fluid in a chordal direction between the medial channel and the downstream channel. The vane structure additionally includes a cooling fluid inlet for providing cooling fluid from the cooling fluid supply to the upstream channel. The cooling fluid inlet extends through the outer end turn structure from a location radially outwardly from the outer surface to the upstream channel.

In accordance with a further aspect of the invention, a vane structure is provided for a gas turbine engine. The vane structure comprises a radially outer platform and a radially inner platform. An airfoil is provided including an airfoil outer wall extending radially between the outer platform and the inner platform, and the outer wall includes chordally spaced leading and trailing edges. A cooling passage is defined within the outer wall and has a plurality of radially extending channels. An end turn structure extends radially from a side of at least one of the inner and outer platforms opposite from the airfoil to conduct cooling fluid in a chordal direction between at least two of the channels. The vane structure additionally includes upstream and downstream rail structures extending radially from the at least one platform, and the end turn structure has an upstream end adjoining an intersection of the upstream rail structure with the at least one platform and a downstream end adjoining an intersection of the downstream rail structure with the at least one platform.

In accordance with additional aspects of the invention: the enlarged dimension may be greater than a dimension of each of at least two of the channels, in the direction transverse to the chordal direction, at a location of the channels adjacent to the enlarged portion; the enlarged portion may extend from a location radially outwardly from the outer surface of the outer platform to a location radially inwardly from the outer surface of the outer platform; upstream and downstream inner rail structures may be provided extending radially inwardly from an inner surface of the inner platform, and including an inner end turn structure having an upstream end adjoining an intersection of the upstream inner rail structure with the inner surface of the inner platform and a downstream end adjoining an intersection of the downstream inner rail structure with the inner surface of the inner platform; the outer wall of the airfoil may include a pressure sidewall and a suction sidewall, and the plurality of channels of the cooling passage may include first, second and medial channels defined by first and second partitions extending between the pressure and suction sidewalls, the second partition may be located between the medial channel and the second channel, and the second partition having an inner end located adjacent the inner platform and having an outer end radially located generally aligned with the inner surface of the outer platform; the cooling fluid inlet may extend to the first or upstream channel and the enlarged portion of the outer end turn structure may provide fluid communication between the medial channel and the downstream channel; the upstream channel may conduct cooling fluid from the cooling fluid inlet in a radially inward direction toward the inner platform, the medial channel may conduct cooling fluid in a radially outward direction toward the outer platform, and the downstream channel may conduct cooling fluid in the radially inward direction; the outer surface of the outer platform may define a substantially planar portion, and a fillet portion may be provided defining a radius from a radially outer portion of the outer end turn structure to the substantially planar surface for effecting a reduction in stress in an area of the radius.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
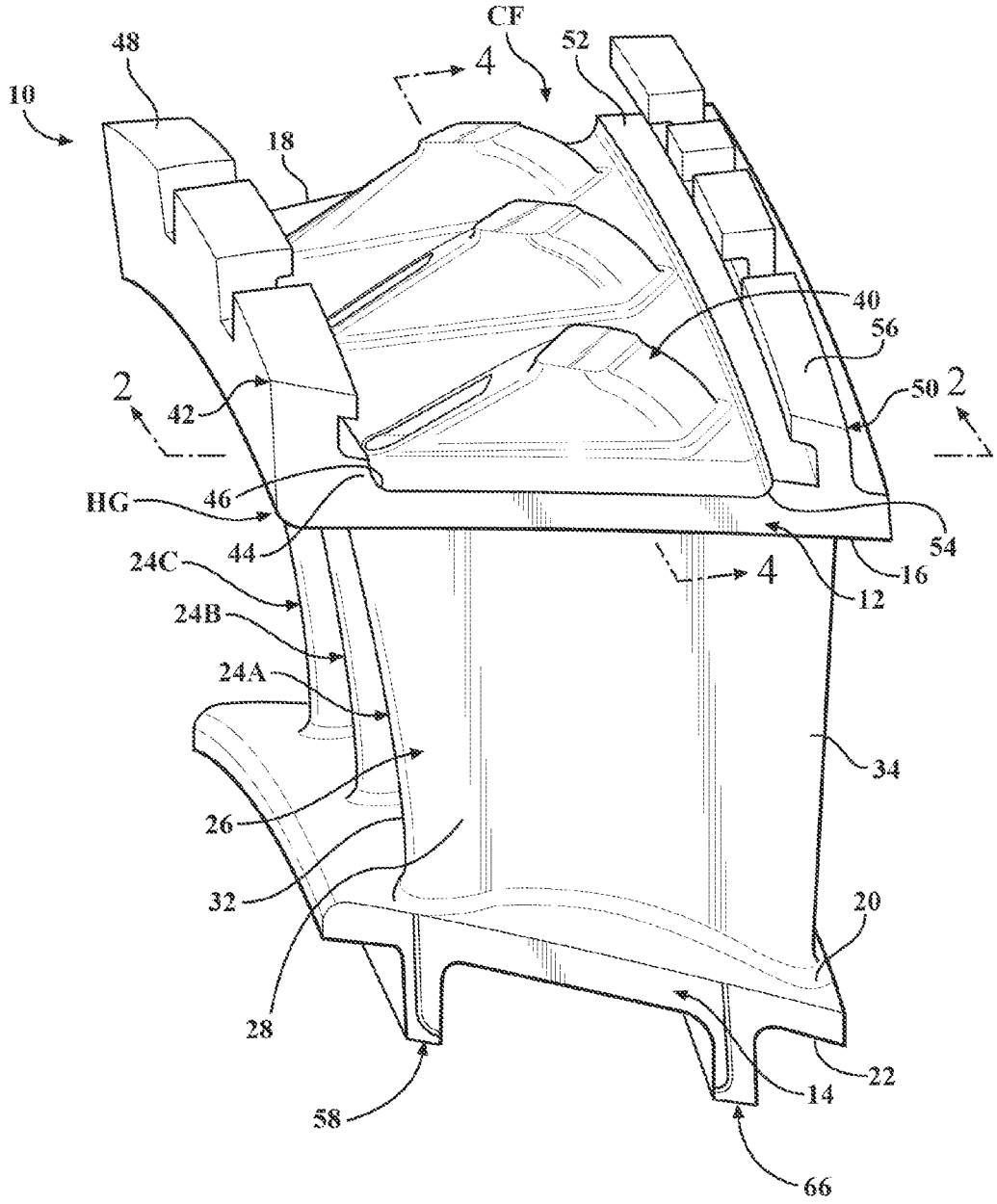
FIG. 1 is perspective view of a vane structure illustrating the present invention.

Referring to FIG. 1, a vane structure 10 is illustrated including a radially outer platform 12 and a radially inner platform 14. The outer platform 12 includes an inner, substantially planar surface 16 defining an outer portion of a hot gas path HG through a gas turbine engine, and an opposing outer, substantially planar surface 18 for fluid communication with a cooling fluid source CF. The inner platform 14 includes an outer, substantially planar surface 20 defining an inner portion of the hot gas path HG, and an opposing inner, substantially planar surface 22. It should be understood that the planar surfaces described herein may comprise a slight curvature such as to correspond to a circumferential curvature of the annular gas path extending through the turbine engine, while defining a surface that is locally substantially planar.

The illustrated vane structure 10 includes a plurality of airfoils 24A, 24B, 24C extending radially between the outer and inner platforms 12, 14 and spaced from each other in a circumferential direction. The airfoils 24A, 24B, 24C may have a substantially identical construction and will be described with reference to the airfoil 24A, it being understood that the other airfoils 24B and 24C may be of substantially similar construction. Further, it should be understood that the vane structure 10 may be formed with a fewer number or a greater number of airfoils than those shown herein.

Figure 4A:
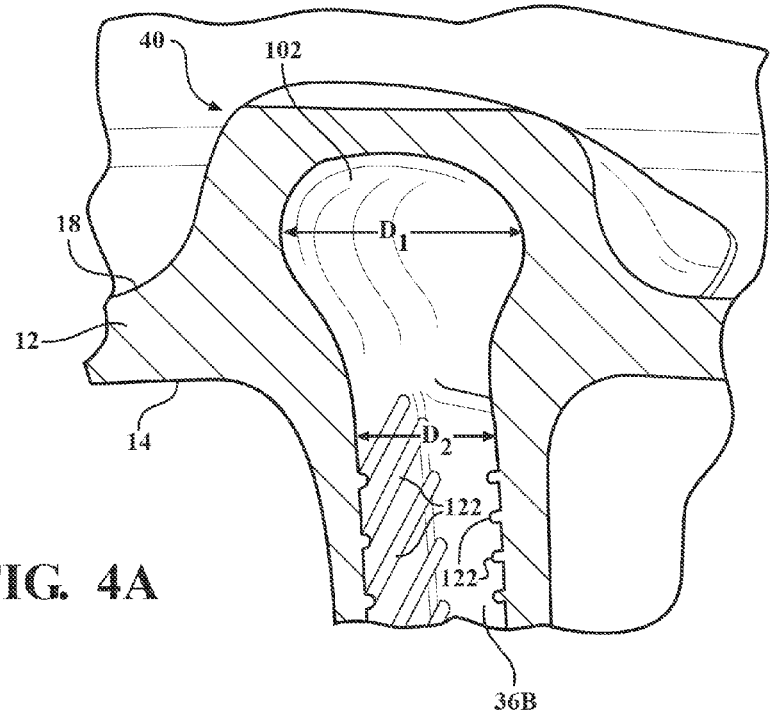
FIG. 4A is an enlarged view of an upper portion of a vane in FIG. 4 showing an upper end turn of a cooling channel.
Figure 4:
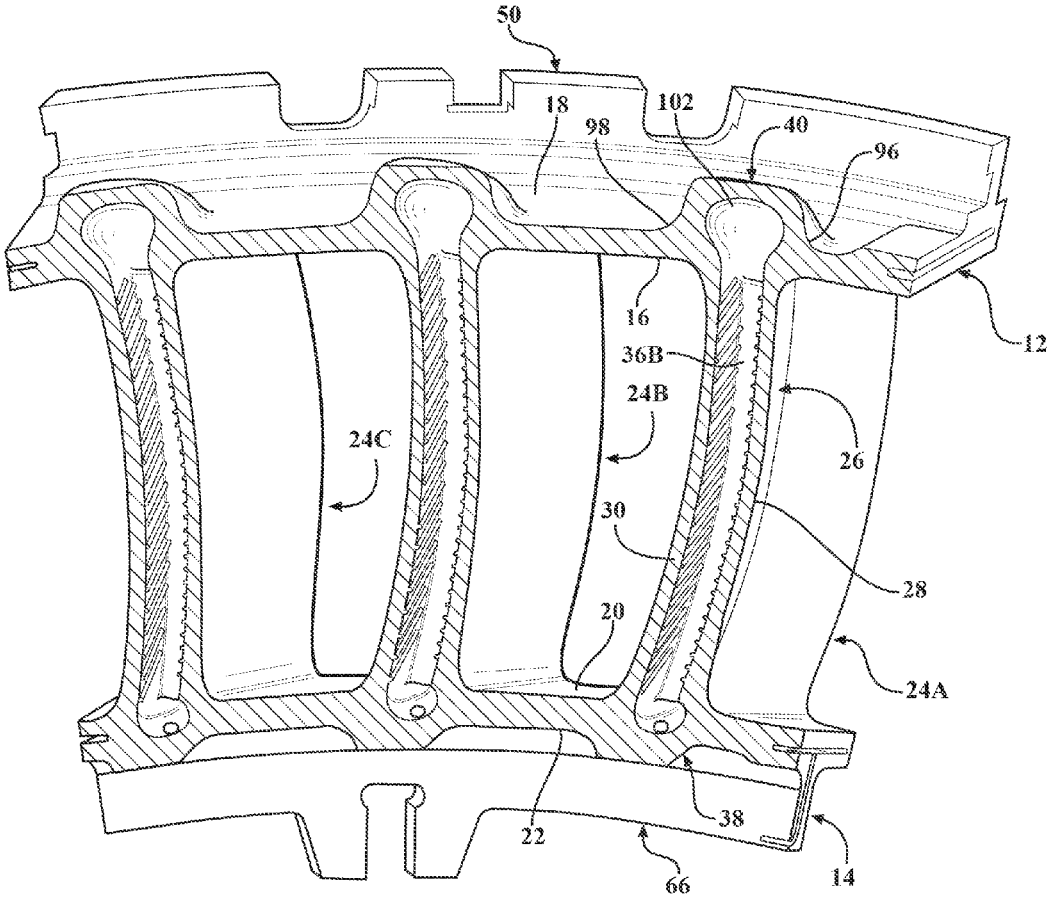
FIG. 4 is a cross-sectional view taken along line 4-4 in FIG. 1.

As seen in FIGS. 1 and 4, the airfoil 24A comprises an outer wall 26 formed by a concavely curved pressure sidewall 28 and a convexly curved suction sidewall 30. The pressure sidewall 28 and suction sidewall 30 are joined together at chordally spaced leading and trailing edges 32, 34. As is further seen in FIG. 2, a cooling passage 36 is defined within the outer wall 26 of the airfoil 24A and comprises a plurality of radially extending cooling channels including at least a first or upstream cooling channel 36A, a second or downstream cooling channel 36C, and a medial cooling channel 36B located between the upstream and downstream cooling channels 36A, 36C.

The upstream cooling channel 36A may be defined between the leading edge 32 and a first partition 37 extending between the pressure and suction sidewalls 28, 30. The medial cooling channel 36B is defined between the first partition 37 and a second partition 39 extending between the pressure and suction sidewalls 28, 30. The downstream cooling channel 36C is defined between the second partition 39 and the trailing edge 34. The upstream cooling channel 36A is fluid communication with the medial cooling channel 36B through an inner end turn structure 38, and the medial cooling channel 36B is in fluid communication with the downstream cooling channel 36C through an outer end turn structure 40, as is described further below.

Figure 2:
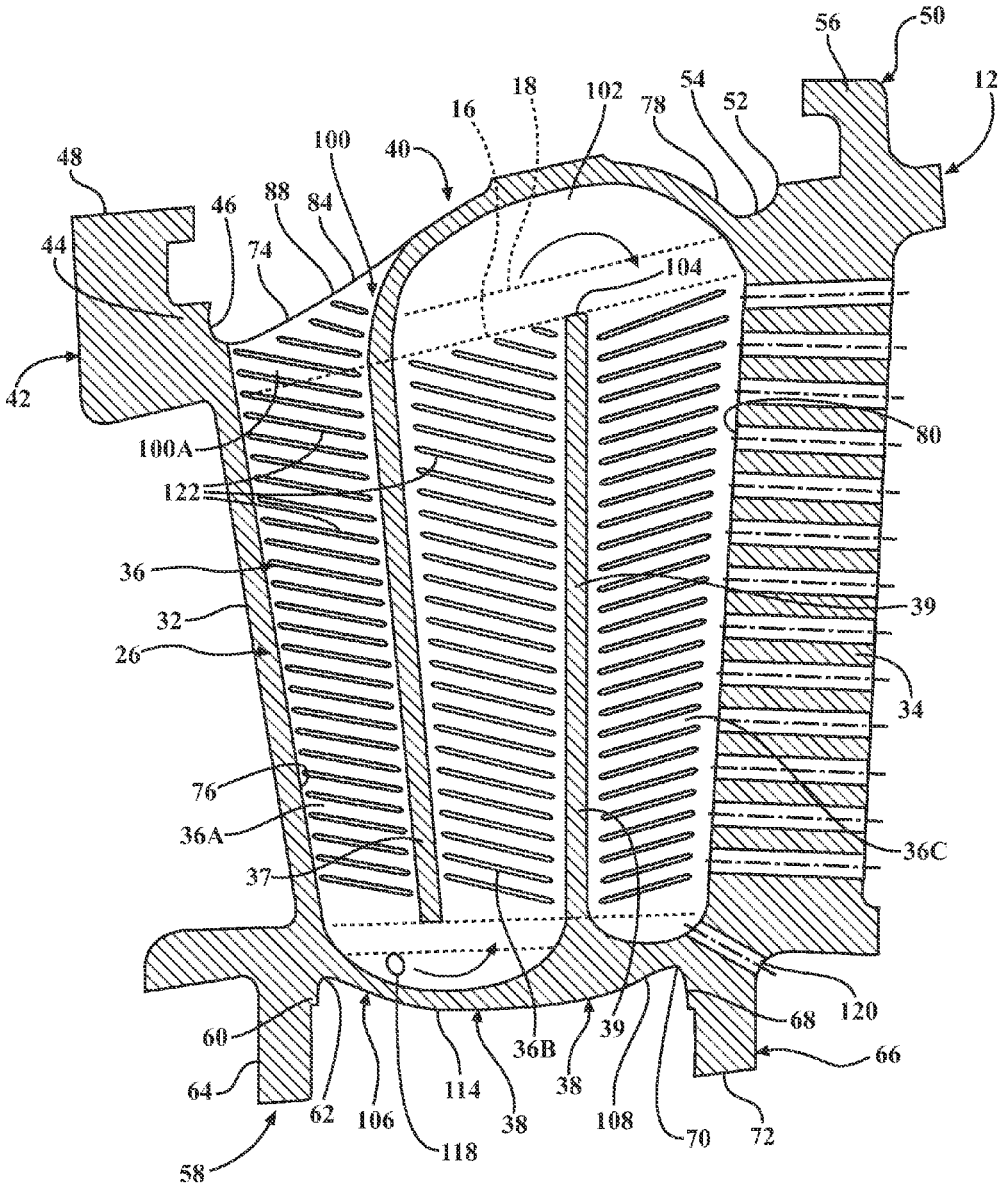
FIG. 2 is a cross-sectional view taken through one of the vanes along line 2-2 in FIG. 1.

Referring to FIGS. 1 and 2, an upstream outer rail structure 42 extends radially outwardly from a forward end of the outer platform 12. The upstream outer rail structure 42 includes a base portion 44 that intersects the outer platform 12 at a location 46, and an upstream hook portion 48 for supporting the vane structure 10 to a vane carrier (not shown). A downstream outer rail structure 50 extends radially outwardly from a rearward end of the outer platform 12. The downstream outer rail structure 50 includes a base portion 52 that intersects the outer platform 12 at a location 54, and a downstream hook portion 56 for supporting the vane structure 10 to the vane carrier.

Figure 5:
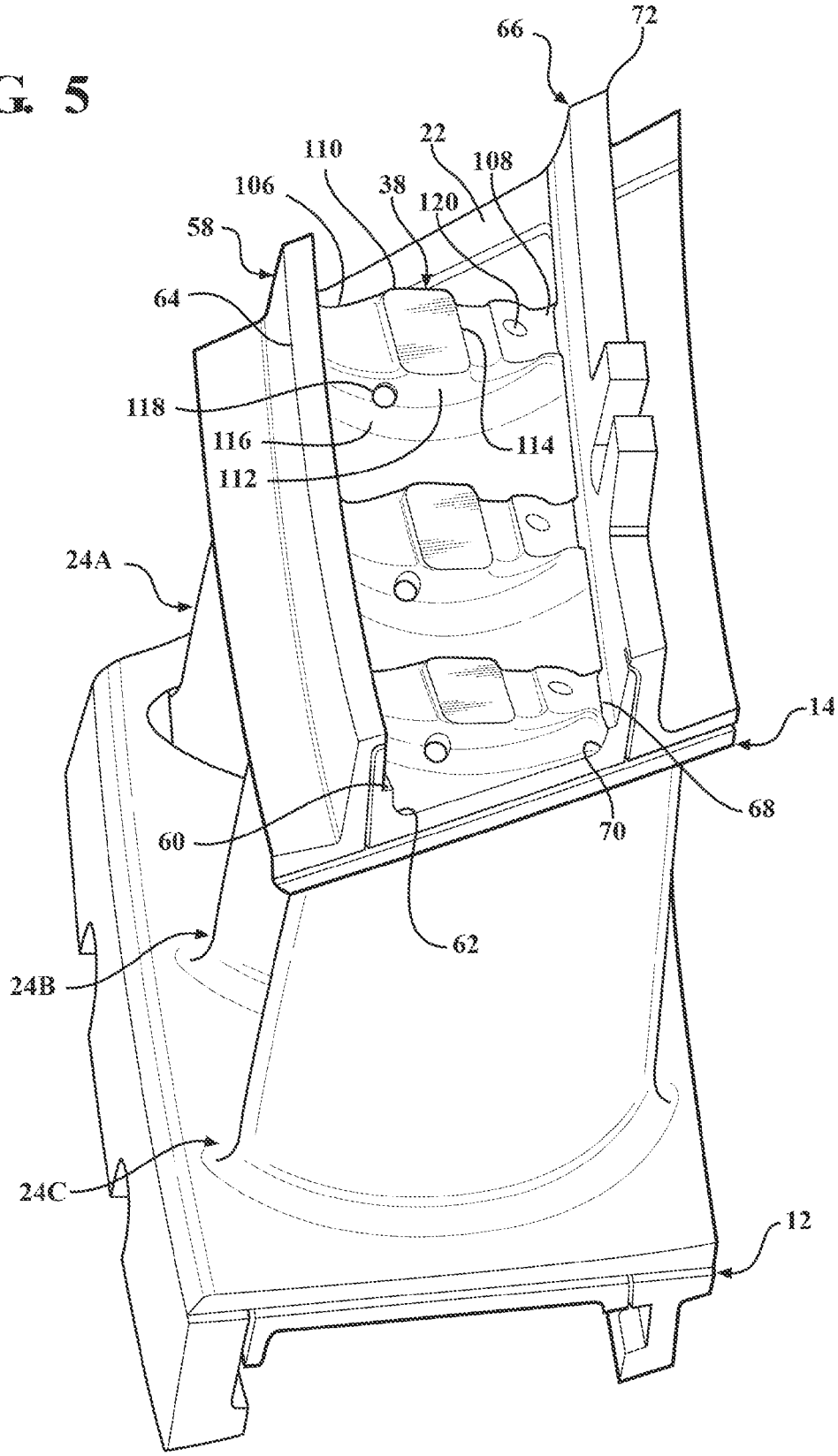
FIG. 5 is a bottom perspective view of the vane structure of FIG. 1.

Referring to FIGS. 1 and 5, an upstream inner rail structure 58 extends radially inwardly, i.e., toward a rotor (not shown) of the engine, from a forward end of the inner platform 14. The upstream inner rail structure 58 includes a base portion 60 that intersects the inner platform 14 at a location 62, and an upstream flange portion 64 for engagement with a seal structure (not shown) located radially inwardly from the seal structure 10 in the turbine engine. A downstream inner rail structure 66 extends radially inwardly from a rearward end of the inner platform 14. The downstream inner rail structure 66 includes a base portion 68 that intersects the inner platform 14 at a location 70, and a downstream flange portion 72 for engagement with a seal structure (not shown).

Referring to FIGS. 1 and 2, the outer end turn structure 40 is located at the outer surface 18 of the outer platform 12 extending radially outwardly from the outer surface 18 of the outer platform 12. The outer end turn structure 40 includes an upstream end 74 extending in a forward direction to a chordal location substantially adjacent to a forward side 76 of the upstream cooling channel 36A, and preferably substantially adjoins or is blended into the location 46 where the upstream outer rail structure 42 intersects the outer surface 18 of the outer platform 12. The outer end turn structure 40 also includes a downstream end 78 extending in a rearward direction to a chordal location at least to a rearward side 80 of the downstream cooling channel 36C, and preferably substantially adjoins or is blended into the location 54 where the downstream outer rail structure 50 intersects the outer surface 18 of the outer platform 12.

Figure 3:
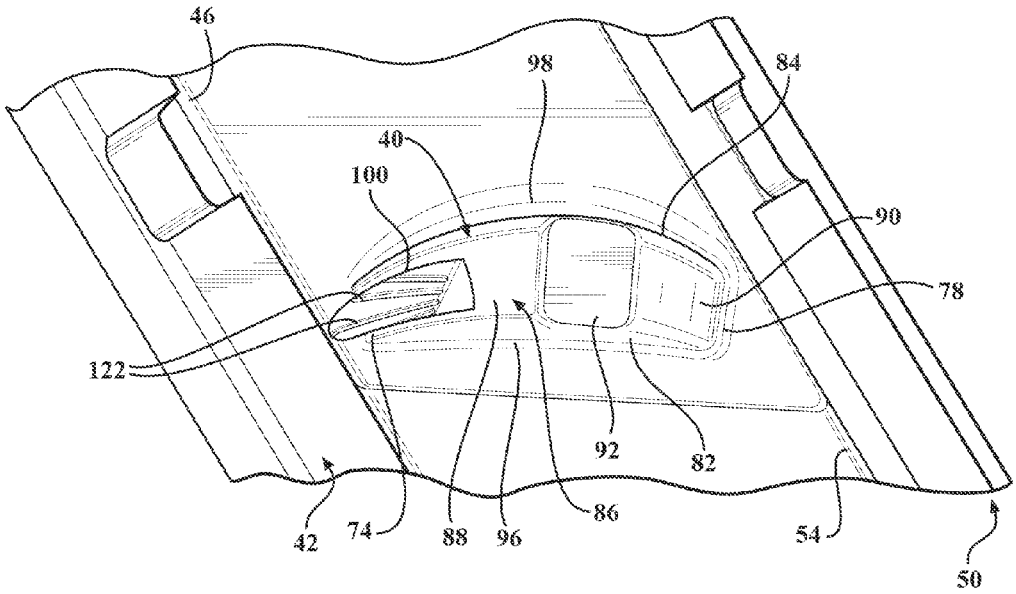
FIG. 3 is top perspective view of a portion of the vane structure of FIG. 1.

Referring further to FIG. 3, the outer end turn structure 40 comprises opposing first and second end turn walls 82, 84 extending in the chordal direction of the airfoil 24A. The first and second end turn walls 82, 84 extend radially outwardly, and each of the end turn walls 82, 84 may be formed with an orientation and curvature, in the chordal direction, that substantially matches the orientation and curvature of a respective one of the pressure and suction sidewalls 28, 30. The outer end turn structure 40 further includes a generally arched outer portion 86 extending between the end turn walls 82, 84. The outer portion 86 may include a front outer portion 88, a rear outer portion 90 and a central outer portion 92 located between the front and rear outer portions 88, 90. Although the central outer portion 92 in the illustrated embodiment comprises a flat portion, it should be understood that the outer portion 86 may comprise a surface that is substantially continuously smoothly contoured across the front outer portion 88, the central outer portion 92 and the rear outer portion 90.

The upstream end 74 of the outer end turn structure 40 is defined at a forward edge of the front outer portion 88, and the downstream end 78 of the outer end structure 40 is defined at a rearward edge of the rear outer portion 90. Further, the first and second end turn walls 82, 90 intersect the outer surface 18 of the outer platform 12 at respective first and second side edges 96, 98. The upstream and downstream ends 74, 78 and the first and second side edges 96, 98 define blended junction locations comprising curved surfaces that form a fillet having predetermined radii between the respective front and rear outer portions 88, 90 and the outer surface 18, and between the first and second end turn walls 82, 90 and the outer surface 18. In particular, blend radii are defined at the intersections of the ends 74, 78 with the outer surface 18, and at the intersections of the side edges 96, 98 with the outer surface 18 to avoid or reduce thermal stress concentrations between the outer end turn structure 40 and the outer platform 12. The blend radii are preferably no less than about 5 mm, and may comprise radii that vary in both the radial direction and around the circumference defined by the intersection of the outer end turn structure 40 with the outer surface 18 of the outer platform 12.

In accordance with the present configuration for an outer end turn structure 40, it has been observed that in prior structures defining turns for cooling channels, increased thermal gradients have been formed between a vane platform and structure forming the cooling channel turns, resulting in increased thermal stress. It has further been observed that thermal stresses have particularly been formed in prior designs at a junction between vane platforms and structure forming cooling channel turns adjacent to a downstream side of an air inlet formed through a radially outer vane platform, at a terminal forward end of the structure forming the cooling channel turns, as well as at other locations where a cooling channel structure meets or joins a vane platform. In accordance with the present configuration for a vane structure 10, the blended junction locations 74, 78, 96, 98 provide junctions where stresses may be more evenly distributed through the junction area.

The thermal stress may be further reduced by the configuration of the outer end turn structure 40 extending to upstream and downstream locations substantially adjacent to the respective upstream and downstream outer rail structures 42, 50. The extended outer end turn structure 40 provides additional thermal mass to distribute the thermal load from the platform 12, while providing additional surface area for convective heat transfer. The extension of the front and rear outer turn portions 88, 90 to locations adjoining the respective upstream and downstream outer rail structures 42, 50 additionally may reduce the stress concentration factor in the area of the outer end turn structure 40 by providing a distribution of loads attributed to thermal stress over a longer portion of the outer end turn structure 40.

A portion of the side walls 82, 84 forming the front outer portion 88 extends on either side of a cooling fluid inlet 100 to locate the cooling fluid inlet radially outwardly from the outer surface 18 of the outer platform 12, as seen in FIGS. 2 and 3. Cooling fluid from the cooling fluid supply CF is provided at a sufficient pressure to the cooling fluid inlet 100 to convey the cooling fluid into the first cooling fluid channel 36A and through the cooling passage 36. Hence, opposing surfaces of the portions of the side walls 82, 84 defining the cooling fluid inlet 100 may be exposed to the cooling fluid to provide a transfer of heat away from an entrance portion 100A of the upstream cooling channel 36A at the outer platform 12, and further reduce the thermal gradient and associated thermal stress in the area surrounding the upstream cooling channel entrance portion 100A.

In accordance with a further aspect of the invention, the outer end turn structure 40 may be formed with a reduced height, i.e., a reduced radial outward extension, as compared to prior structures defining turns for cooling channels. In particular, the outer end turn structure 40 may have a height that is substantially radially inwardly from the hook portions 48, 56, resulting in the entire outer end turn structure 40 being closer to the hot outer platform 12 and having a higher temperature than if it extended further radially outwardly. Hence, a thermal gradient between the outer end turn structure 40 and the outer platform 12 is reduced, with an associated reduction in thermal stress. It may be noted that an impingement plate (not shown) may be located radially outwardly from the outer end turn structure 40 and radially inwardly from the hook portions 48, 56 for providing impingement cooling air from the cooling fluid source CF to the outer end turn structure 40. In accordance with this aspect, and in order to maintain a desired level of heat transfer between the outer end turn structure 40 and cooling fluid supplied by the cooling fluid source CF, a downstream channel passage is formed as a bulb or enlarged portion 102 for conducting cooling fluid between the medial cooling channel 36B and the downstream cooling channel 36C in a chordal direction, i.e., in a generally axial direction extending from the leading edge 32 toward the trailing edge 34.

As seen in FIG. 4A, the enlarged portion 102 may be formed with a cross-section, as viewed in the chordal direction, generally configured as a circular or elliptical shape, and may extend radially from a location radially outwardly from the outer surface 18 to a location radially inwardly from the outer surface 18 of the outer platform 12. In the illustrated embodiment, the radially inner location of the enlarged portion 102 may located between the inner and outer surfaces 16, 18 of the outer platform 12. Further, the enlarged portion 102 may be formed with an enlarged or maximum dimension D1, in a direction transverse to the chordal direction, which is greater than a dimension D2 of either of the medial and downstream cooling channels 36B, 36C, as measured in the direction transverse to the chordal direction, adjacent to the enlarged portion 102. It should be understood that the enlarged portion 102 extends chordally from a location radially outwardly of the medial cooling channel 36B to a location radially outwardly of the downstream cooling channel 36C, and that the particular cross-sectional configuration of the enlarged portion 102 may vary along the chordal direction between the medial and downstream cooling channels 36B and 36C. The enlarged portion 102 provides an additional cross-sectional area for cooling fluid flow, and may provide additional cooling to the area of the platform 12 where the outer end turn structure 40 is joined to the outer platform 12, as well as provide additional heat transfer surface area for providing transfer of heat away from the cooling fluid to the outer end turn structure 40 having an outer surface exposed to the cooling fluid source CF. In addition, it should be noted that the second partition 39 includes a radially outer end 104 (FIG. 2) that extends to a radial location generally aligned with the inner surface 16 of the outer platform 12, such that the cooling fluid passing from the medial cooling channel 36B to the downstream cooling channel 36C through the enlarged portion 102 may be channeled in the outer end turn structure 40 to provide cooling to the outer platform 12 between the inner and outer surfaces 16, 18.

Referring to FIGS. 2 and 5, the inner end turn structure 38 includes an upstream end 106 extending in a forward direction to a chordal location substantially adjoining or blended into the location 62 where the upstream inner rail structure 58 intersects the inner platform 14. The inner end turn structure 38 also includes a downstream end 108 extending in a rearward direction to a chordal location substantially adjoining or blended into the location 70 where the downstream inner rail structure 66 intersects the inner platform 14. Extension of the inner end turn structure 38 to the upstream and downstream inner rail structures 58, 66 may facilitate transfer of heat to the inner rail structures 58, 66. For example, heat transferred to the inner end turn structure 38 from the inner platform 14 and from the cooling fluid flowing through the cooling passage 36 may be transferred from the upstream and downstream ends 106, 108 of the inner end turn structure 38 to the respective inner rails 58, 66.

The inner end turn structure may additionally include opposing first and second turn walls 110, 112 extending in the chordal direction of the airfoil 24A. The first and second end turn walls 110, 112 extend radially inwardly, and each of the end turn walls 110, 112 may be formed with an orientation and curvature, in the chordal direction, that substantially matches the orientation and curvature of a respective one of the pressure and suction sidewalls 28, 30. The inner end turn structure 38 further includes an inner portion 114 extending between the end turn walls 110, 112 and which is generally arched in the chordal direction.

The first and second end turn walls 110, 112 intersect the inner surface 22 of the inner platform 14 at respective side edges (only side edge 116 shown). The upstream and downstream ends 106, 108 and the side edges (as illustrated by side edge 116) define blended junction locations comprising curved surfaces that form a fillet having a predetermined radius between the inner end turn structure 38 and the inner platform 14. The blended junction locations avoid or reduce thermal stress concentrations between the inner end turn structure 38 and the inner platform 14, in a manner similar to that described above with regard to the outer end turn structure 40. The blend radii at the blend junction locations are preferably no less than about 5 mm, and the radii may vary in both the radial direction and around the circumference defined by the intersection of the inner end turn structure 38 with the inner surface 22 of the inner platform 14.

The inner end turn structure 38 may be provided with one or more discharge apertures 118 formed in the end turn walls 110, 112 adjacent an inner end of the upstream cooling channel 36A. Further, a cooling fluid exit aperture 120 may be formed in the arched inner portion 114 of the inner end turn structure 38 adjacent to an inner end of the downstream cooling channel 36C. The discharge apertures 118 and exit aperture 120 may discharge cooling fluid into an inner seal area located in the engine radially inwardly from the inner platform 14. In addition, a plurality of trip strips 122 may be formed along the interior surfaces defining the cooling passage 36 to facilitate heat transfer between the cooling fluid and the surfaces of the cooling passage 36. The trip strips 122 may also be provided to the end turn structures 38, 40. For example, trip strips 122 may be provided to the cooling fluid inlet 100 (FIGS. 2 and 3) to thereby facilitate cooling of the first and second end turn walls 82, 84 to further reduce the thermal gradient in the outer end turn structure 40.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A vane structure for a gas turbine engine, said vane structure comprising:

a radially outer platform including an inner surface defining a portion of a hot gas path through said gas turbine engine and an opposing outer surface in communication with a cooling fluid source;

a radially inner platform including an outer surface defining a portion of said hot gas path and an opposing inner surface;

an airfoil including an airfoil outer wall extending radially between said outer platform and said inner platform, said outer wall including chordally spaced leading and trailing edges, and spaced pressure and suction sidewalls extending between and joined at said leading and trailing edges;

a cooling passage defined within said outer wall and having a plurality of radially extending channels including an upstream channel, a downstream channel and a medial channel between said upstream channel and said downstream channel;

said upstream channel being defined between said pressure and suction sidewalls where they join at said leading edge, and said upstream channel conducts cooling fluid from said cooling fluid inlet in a radially inward direction toward said inner platform, said medial channel conducts cooling fluid from said upstream channel in a radially outward direction toward said outer platform and said downstream channel conducts cooling fluid from said medial channel in said radially inward direction;

an outer end turn structure extending radially outwardly from said outer surface of said outer platform to conduct cooling fluid in a chordal direction between said medial channel and said downstream channel;

including a cooling fluid inlet for providing cooling fluid from said cooling fluid supply to said upstream channel, said cooling fluid inlet extending through said outer end turn structure from a location radially outwardly from said outer surface to said upstream channel;

said outer end turn structure including an enlarged portion wherein said enlarged portion is formed by an internal passage wall defining an enlarged dimension, in a direction transverse to said chordal direction and perpendicular to the radial direction, for conducting cooling fluid between said medial channel and said downstream channel; and at chordal sections comprising sections taken radially through each of said medial channel and said downstream channel, and viewed in the chordal direction, said enlarged dimension is greater than a dimension of each of said medial and downstream channels, as determined at each said chordal section and measured in said direction transverse to said chordal direction and perpendicular to the radial direction, at a location adjacent to said enlarged portion.

2. The vane structure of claim 1, wherein said enlarged portion extends from a location radially outwardly from said outer surface of said outer platform to a location radially inwardly from said outer surface of said outer platform.

3. The vane structure of claim 1, including an upstream outer rail structure and a downstream outer rail structure, said upstream and downstream outer rail structures extending radially outwardly from said outer surface, said outer end turn structure having an upstream end adjoining an intersection of said upstream outer rail structure with said outer surface and a downstream end adjoining an intersection of said downstream outer rail structure with said outer surface.

4. The vane structure of claim 1, wherein said enlarged portion is configured as a generally circular shape, as viewed at said chordal sections.

5. A vane structure for a gas turbine engine, said vane structure comprising:

a radially outer platform;

a radially inner platform;

an airfoil including an airfoil outer wall extending in a radial direction between said outer platform and said inner platform, said outer wall including chordally spaced leading and trailing edges;

a cooling passage defined within said outer wall and having a plurality of radially extending channels;

an outer end turn structure located at said outer platform to conduct cooling fluid in a chordal direction between at least two of said channels, said outer end turn structure including an enlarged portion wherein said enlarged portion is formed by an internal passage wall defining an enlarged dimension, in a direction transverse to said chordal direction and perpendicular to the radial direction, between said at least two channels; and at chordal sections comprising sections taken radially through each of said at least two channels and viewed in the chordal direction, said enlarged dimension is greater than a dimension of each of said at least two channels, as determined at each said chordal section and measured in said direction transverse to said chordal direction and perpendicular to the radial direction, at a location adjacent to said enlarged portion.

6. The vane structure of claim 5, wherein said outer platform includes an inner surface defining a portion of a hot gas path through said gas turbine engine and an opposing outer surface in communication with a cooling fluid source, said outer end turn structure extending radially outwardly from said outer surface.

7. The vane structure of claim 6, including an upstream outer rail structure and a downstream outer rail structure, said upstream and downstream outer rail structures extending radially outwardly from said outer surface, said outer end turn structure having an upstream end adjoining an intersection of said upstream outer rail structure with said outer surface and a downstream end adjoining an intersection of said downstream outer rail structure with said outer surface.

8. The vane structure of claim 7, including an upstream inner rail structure and a downstream inner rail structure, said upstream and downstream inner rail structures extending radially inwardly from an inner surface of said inner platform, and including an inner end turn structure having an upstream end adjoining an intersection of said upstream inner rail structure with said inner surface of said inner platform and a downstream end adjoining an intersection of said downstream inner rail structure with said inner surface of said inner platform.

9. The vane structure of claim 6, wherein said enlarged portion extends from a location radially outwardly from said outer surface to a location radially inwardly from said outer surface.

10. The vane structure of claim 9, wherein said outer wall includes a pressure sidewall and a suction sidewall, and said plurality of channels of said cooling passage include first, second and medial channels defined by first and second partitions extending between said pressure and suction sidewalls, said second partition located between said medial channel and said second channel, and said second partition having an inner end located adjacent said inner platform and having an outer end radially located generally aligned with a radial location of said inner surface of said outer platform.

11. The vane structure of claim 6, including a cooling fluid inlet for providing cooling fluid from said cooling fluid supply to one of said plurality of channels of said cooling passage, said cooling fluid inlet extending through said outer end turn structure radially outwardly from said outer surface.

12. The vane structure of claim 11, wherein said plurality of channels of said cooling passage include an upstream channel, a downstream channel and a medial channel between said upstream channel and said downstream channel, said cooling fluid inlet extending to said upstream channel and said enlarged portion of said outer end turn structure providing fluid communication between said medial channel and said downstream channel.

13. The vane structure of claim 6, wherein said outer surface defines a substantially planar portion, and including a fillet portion defining a radius from a radially outer portion of said outer end turn structure to said substantially planar surface for effecting a reduction in stress in an area of said radius.

14. The vane structure of claim 5, wherein said enlarged portion is configured as a generally circular shape, as viewed at said chordal sections.

15. A vane structure for a gas turbine engine, said vane structure comprising:

a radially outer platform;

a radially inner platform;

an airfoil including an airfoil outer wall extending radially between said outer platform and said inner platform, said outer wall including chordally spaced leading and trailing edges;

a cooling passage defined within said outer wall and having a plurality of radially extending channels;

an end turn structure extending radially from a side of at least one of said inner and outer platforms opposite from said airfoil to conduct cooling fluid in a chordal direction between at least two of said channels;

including upstream and downstream rail structures extending radially from said at least one platform, and said end turn structure having an upstream end adjoining an intersection of said upstream rail structure with said at least one platform and a downstream end adjoining an intersection of said downstream rail structure with said at least one platform; and wherein said airfoil includes curved pressure and suction sidewalls joined at said leading and trailing edges, said end turn structure includes opposing end turn walls, each said end turn wall defining a curvature substantially matching the curvature of one of said pressure and said suction sidewalls.

16. The vane structure of claim 15, said at least one platform defines a substantially planar portion, and including fillet portions defining a radius from each of said end turn walls to said substantially planar surface for effecting a reduction in stress in an area of said radius.

* * * * *